US007467715B2

(12) United States Patent
Johnson et al.

(10) Patent No.: US 7,467,715 B2
(45) Date of Patent: Dec. 23, 2008

(54) SUPPORT FRAME

(75) Inventors: Ronald Leslie Johnson, Warners Bay (AU); Ronald Keith McGregor, Newcastle (AU)

(73) Assignee: Weatherford Australia Pty Limited, Malaga (AU)

( * ) Notice: Subject to any disclaimer, the term of this patent is extended or adjusted under 35 U.S.C. 154(b) by 150 days.

(21) Appl. No.: 11/205,705

(22) Filed: Aug. 17, 2005

(65) Prior Publication Data

US 2006/0237348 A1 Oct. 26, 2006

(30) Foreign Application Priority Data

Apr. 20, 2005 (AU) ..... 2005201683

(51) Int. Cl.
*B07B 1/49* (2006.01)

(52) U.S. Cl. ..... 209/405; 209/399; 209/403; 209/408; 209/412

(58) Field of Classification Search ..... 209/399, 209/403, 405, 408, 412
See application file for complete search history.

(56) References Cited

U.S. PATENT DOCUMENTS

| | | | | |
|---|---|---|---|---|
| 4,219,412 | A * | 8/1980 | Hassall | 209/399 |
| 7,216,768 | B2 * | 5/2007 | Fisher et al. | 209/395 |
| 2004/0074821 | A1 * | 4/2004 | Russell et al. | 209/405 |
| 2004/0149632 | A1 * | 8/2004 | Schulte et al. | 209/405 |

* cited by examiner

*Primary Examiner*—Patrick H Mackey
*Assistant Examiner*—Terrell H Matthews
(74) *Attorney, Agent, or Firm*—Patterson & Sheridan, L.L.P.

(57) ABSTRACT

A screening assembly support frame includes a body member defining a longitudinal axis. The body member has a pair of parallel, spaced elongate support members with a spacer arrangement extending between the support members. An engaging formation, for engaging a screen panel of the screening assembly to be supported by the body member, is carried on each support member with the body member and the engaging formations being symmetrical about the longitudinal axis.

6 Claims, 7 Drawing Sheets

SUPPORT FRAME

CROSS-REFERENCE TO RELATED APPLICATIONS

This application claims priority to Australian Patent Application Serial No. AU 2005201683, filed on Apr. 20, 2005, which application is herein incorporated by reference in its entirety.

FIELD

This invention relates to a screening assembly. More particularly, the invention relates to a screening assembly support frame.

BACKGROUND

Screening arrangements are widely used in the mining industry, particularly the coal mining industry, for the screening or classifying of ores and slurries. Material to be screened is passed over a vibratory screen deck. Apertures of screen panels arranged on the screen deck pass material having dimensions smaller than the screening apertures of the screen panels while materials having dimensions larger than those of the apertures are retained on a top surface of, and traverse, the panels of the screen deck for further processing.

Due to the abrasive nature of the material being screened, the screen panels wear out, lose their screening efficiency and require replacement. Often, to ensure that the screen panels only pass materials smaller than the relevant aperture size, the screen panels are reinforced to inhibit distortion of the screen panels. It is costly to dispose of such a screen panel. To overcome this problem, the screen panels are provided in two parts with a screen panel removably attached to a support frame. With this arrangement, only the screen panel needs to be replaced when it is worn and the support frame can be reused.

There is a need to provide a more versatile support frame.

SUMMARY

According to the invention, there is provided a screening assembly support frame which includes:

a body member defining a longitudinal axis, the body member having a pair of parallel, spaced elongate support members with a spacer arrangement extending between the support members; and an engaging formation, for engaging a screen panel of the screening assembly to be supported by the body member, carried on each support member with the body member and the engaging formations being symmetrical about the longitudinal axis.

In one embodiment, at least one end of each support member may carry a mounting formation for mounting the body member on an underlying screen deck. Preferably, each end of each support member carries a mounting formation.

In another embodiment, each support member may define at least one receiving formation in an operatively bottom surface for receiving a complementary part of a locating pin for attaching the body member to an underlying screen deck. Preferably, each support member defines a plurality of spaced receiving formations in each of which a locating pin is receivable.

The spacer arrangement may comprise a plurality of longitudinally spaced, transversely extending elements extending between the support members. For example, two longitudinally spaced elements, or struts, may extend between the support members.

Each engaging formation may comprise a clip arrangement for clipping engagement with a corresponding formation of the screen panel. The clip may be a continuous rail-like clip arranged on a top surface of its associated support member. Instead, each engaging formation may be a non-continuous, interrupted clip arrangement carried on the top surface of its associated support member.

The engaging formations may be integrally formed with the body member as a one-piece unit. The body member may be of a synthetic plastics material and may be moulded. Thus, the engaging formations may be moulded with the body member. The plastics material may carry reinforcement.

The plastics material may be a polyurethane material and the reinforcement may be steel reinforcing which also serves to inhibit shrinkage of the plastics material on moulding to minimise distortion of the body member.

The invention extends to a screening assembly including the support frame as described above.

BRIEF DESCRIPTION OF THE DRAWINGS

Embodiments of the invention are now described by way of example with reference to the following drawings in which.

DETAILED DESCRIPTION OF EXEMPLARY EMBODIMENTS

Figure 1:
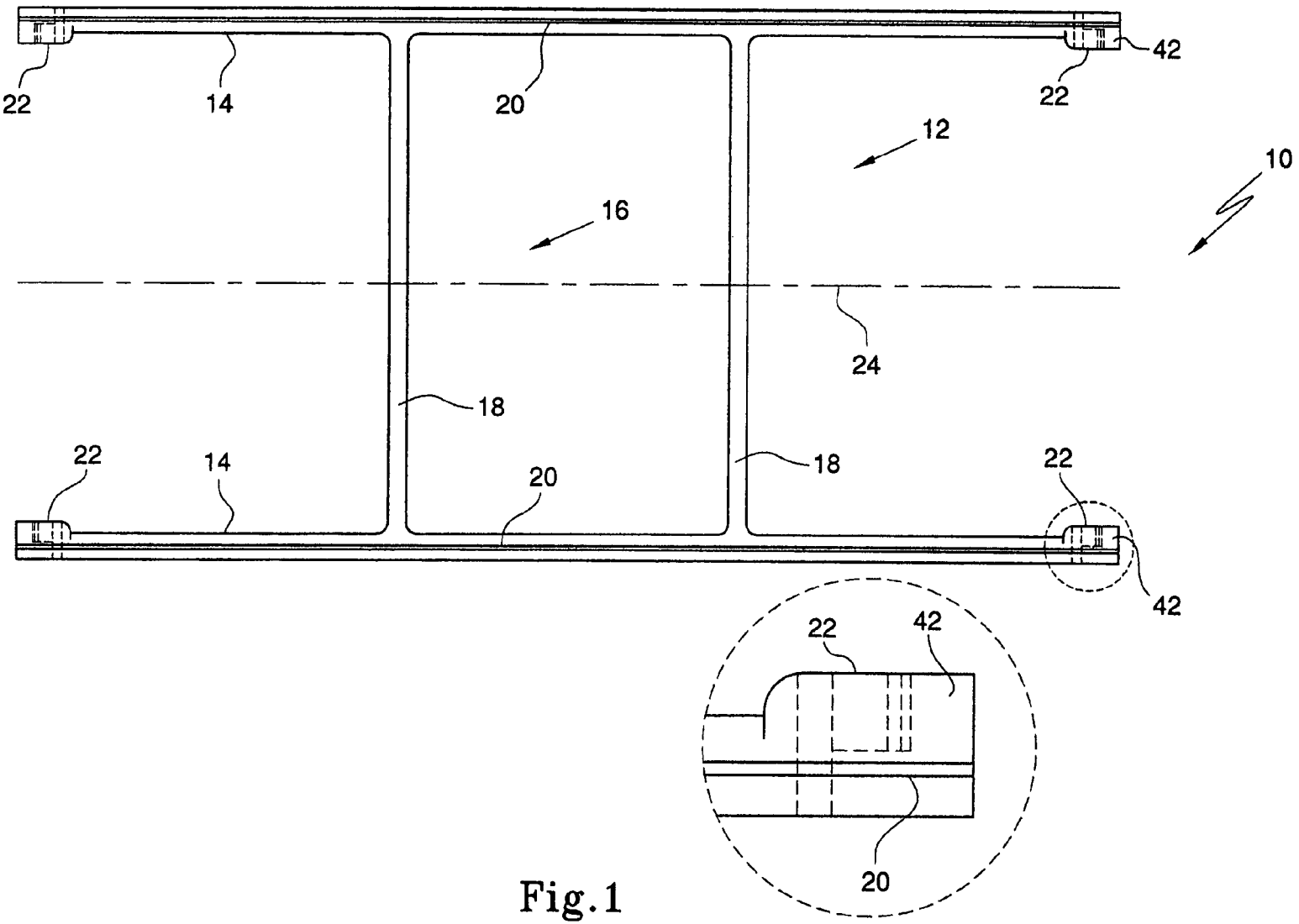
FIG. 1 shows a plan view of a screening assembly support frame, in accordance with an embodiment of the invention.

In the drawings, reference numeral 10 generally designates a screening assembly support frame, in accordance with an embodiment of the invention.

The support frame 10 includes a body member 12 defining a pair of spaced parallel elongate support members 14. The support members 14 are retained in spaced relationship by a spacer arrangement 16.

The spacer arrangement 16 comprising a pair of longitudinally spaced transversely extending elements, or struts, 18.

Each support member 14 supports an engaging formation in the form of a clip 20. The clips 20 engage complementary formations of a removable screen panel of a screening assembly, as will be described in greater detail below.

In this embodiment, a mounting formation 22 is defined at each end of each support member 14. Each mounting formation 22 is also in the form of a clip for engaging an intermediate rail mounted on an underlying screen deck, as will be described in greater detail below.

As shown more clearly in FIG. 1 of the drawings, the support frame 10 defines a longitudinal axis 24. The arrangement of the body member 12, the clips 20 and the mounting formations 22 is such that the support frame 10 is symmetrical about the longitudinal axis 24. This improves the versatility of the support frame 10 and allows for rapid mounting or demounting of the support frame 10 without the need for first determining in which direction the support frame 10 needs to oriented. This reduces the downtime of the screen deck thereby improving the efficiency of the screen deck.

The support frame 10 is a one piece moulding of a suitable synthetic plastics material. More particularly, the support frame 10 is moulded from a polyurethane material. The polyurethane material has a Shore Hardness of 93A or 95A, depending on the application of the support frame 10.

In addition, the support frame 10 is reinforced. Steel reinforcing (not shown) in the same shape as the support members 14 and the struts 18 is first placed in the mould and the polyurethane is moulded about the steel reinforcing. The reinforcing serves to inhibit distortion of the support frame 10, maintains the rigidity of the support frame 10 and inhibits shrinkage of the polyurethane as it cures.

Figure 4:
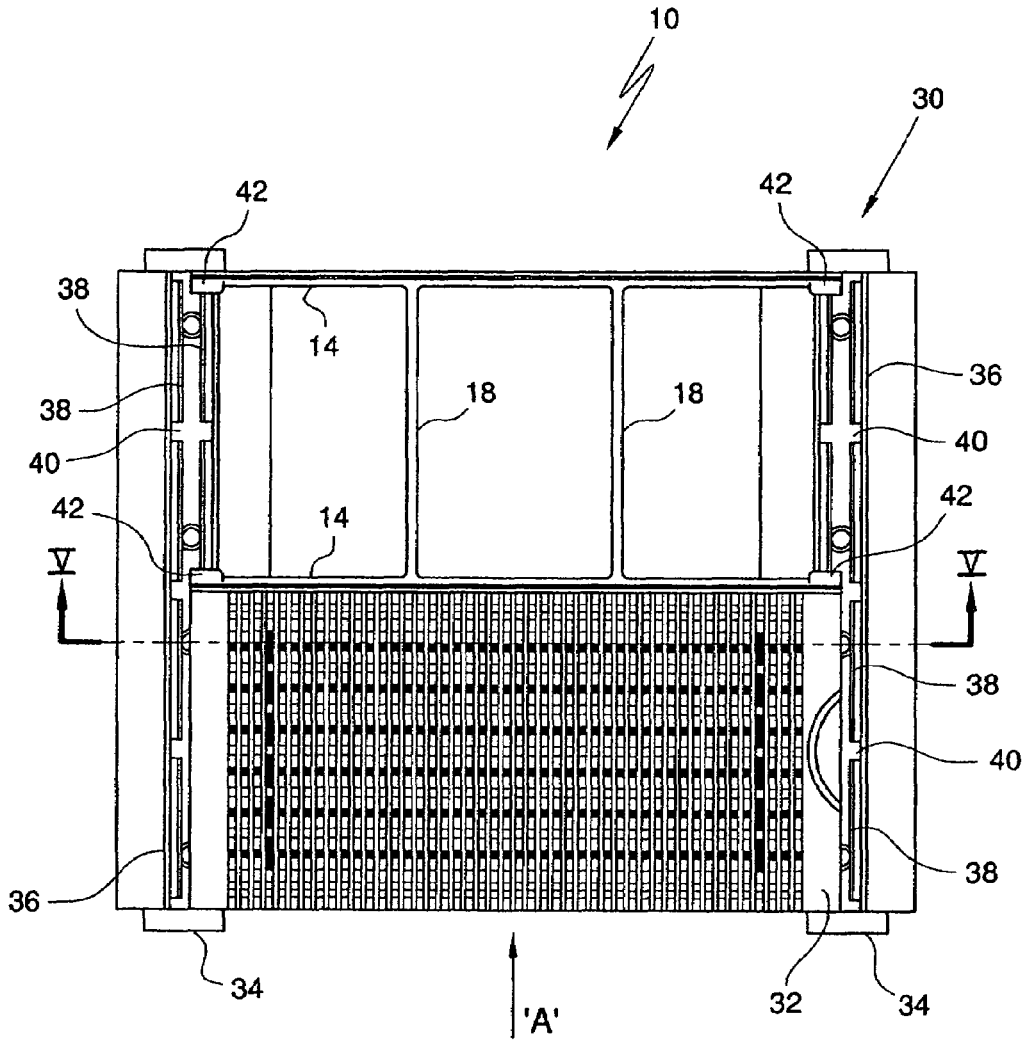
FIG. 4 shows a plan view of a part of a screening assembly including the support frame.
Figure 5:
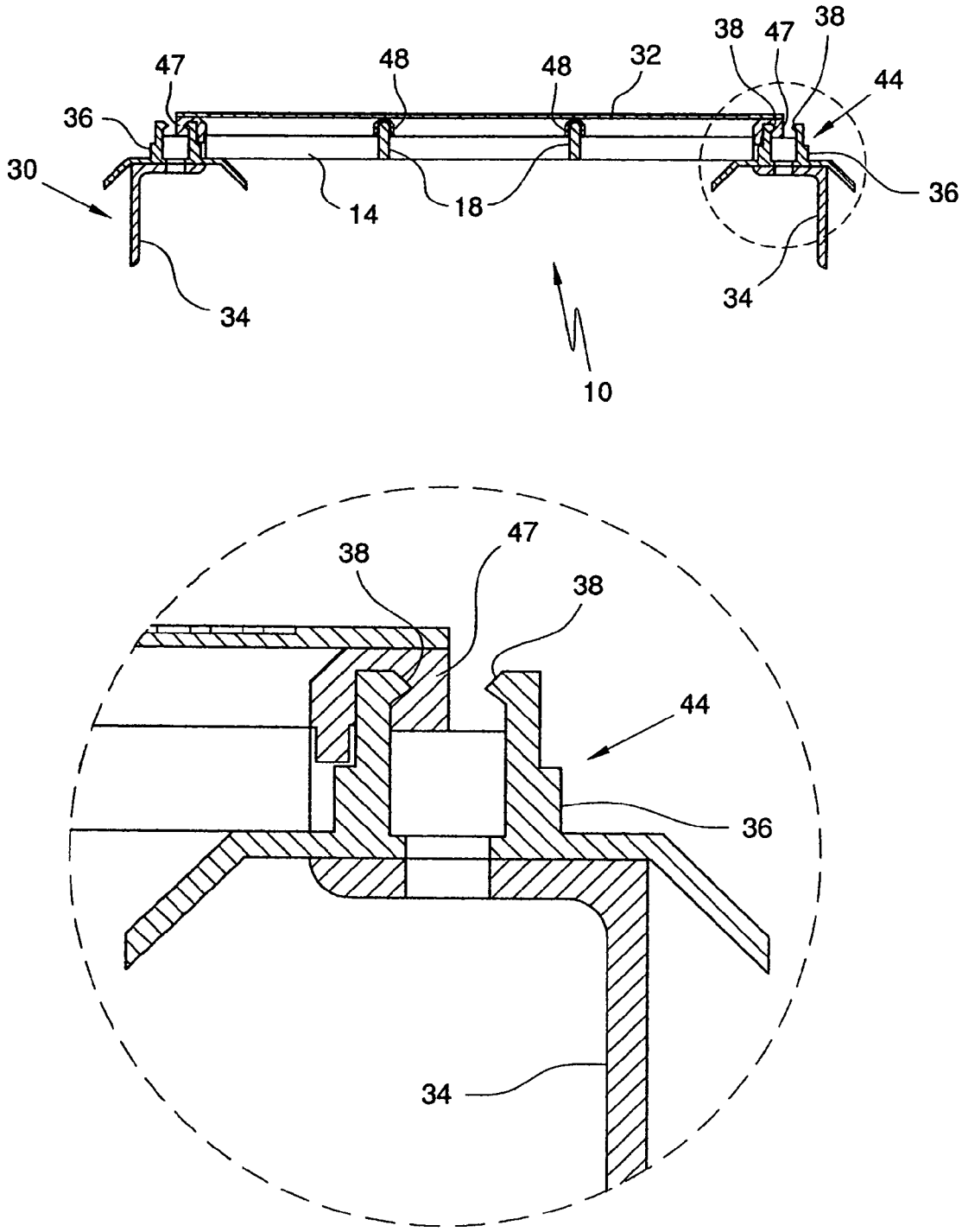
FIG. 5 shows a sectional side view of the part of the screening assembly taken along line V-V in FIG. 4.
Figure 6:
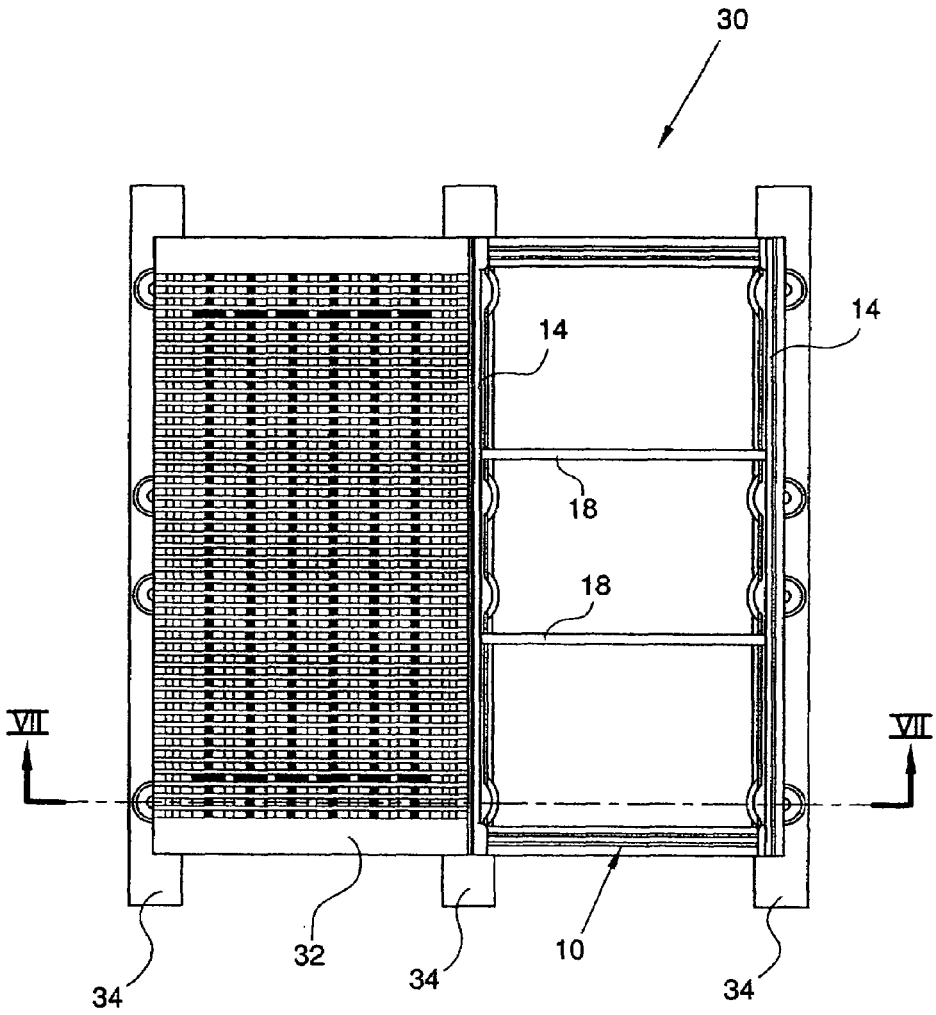
FIG. 6 shows a plan view of a part of a screening assembly including another embodiment of the support frame.
Figure 7:
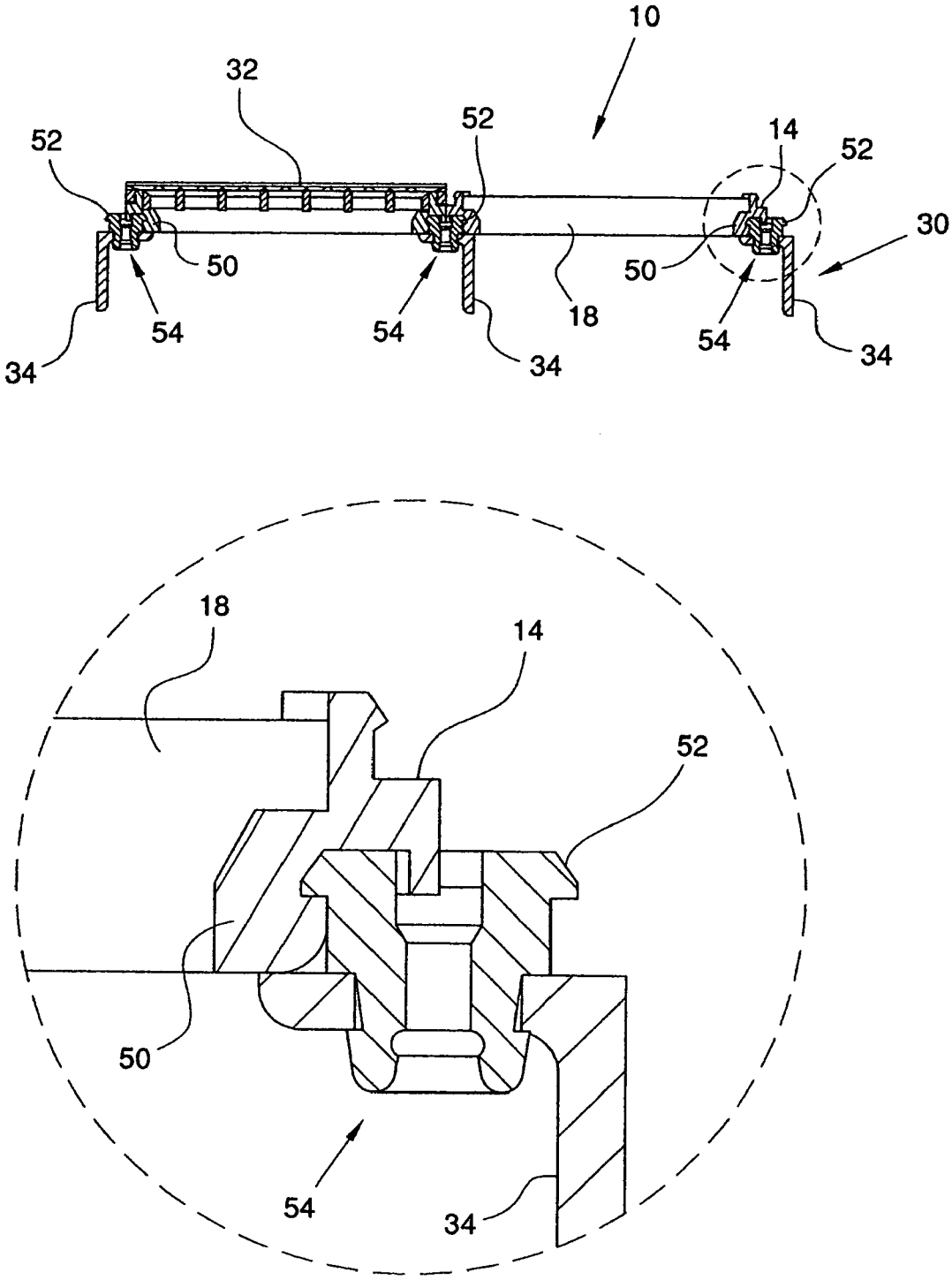
FIG. 7 shows a sectional side view of the part of the screening assembly taken along line VII-VII in FIG. 6.

In use, a plurality of the support frames 10 are mounted on a screen deck, part of which is shown at 30 in FIGS. 4 and 5 of the drawings. Those skilled in the art will appreciate that, what is illustrated in FIGS. 4 and 5 of the drawings is a with-flow screening arrangement where material flows in a direction of arrow A and slots of a screen panel 32, supported on one of the support frames 10, extend parallel to the direction of flow of material. Screening modules, comprising the support frames 10 with their attached screen panels 32, can also be arranged in a cross flow arrangement (as shown in FIGS. 6 and 7).

The screen panel 32 has a clip (not shown) running along an under side of each longer edge of the screen panel 32, the clips of the screen panel 32 releasably clipping on to the clips 20 on the support members 14 of the support frame 10.

The screen deck 30 comprises a machine frame having a plurality of spaced, parallel members 34.

An intermediate rail 36 is mounted on each of the members 34 of the machine frame of the screen deck 30. Each intermediate rail 36 has a pair of opposed clip-like formations 38. As shown more clearly in FIG. 4 of the drawings, these clip-like formations 38 are interrupted by transverse slots 40. The slots 40 are provided at regular intervals along the intermediate rail 36 to facilitate placement of the support frames 10 on the screen deck 30. Typically, the pitch of the space in between adjacent slots 40 is half the length of the support frame 10, the length of the support frame 10 being the spacing between outer sides of the support members 14.

Each clip 22 of the support frame 10 is defined by a boss-like formation 42. When the support frame 10 is mounted on the screen deck 30, each boss-like formation 42 partially occludes one of the slots 40 with the clip 22 of that boss-like formation 42 engaging an end its associated clip-like formation 38 of the intermediate rail 36. It will be noted in FIG. 4 of the drawings that these boss-like formations 42 take up half of the width of the slot 40 so that a boss-like formation 42 of an adjacent support frame 10 can be received in the same slot 40 in a tight fit to locate adjacent support frames 10 with respect to each other.

Figure 2:
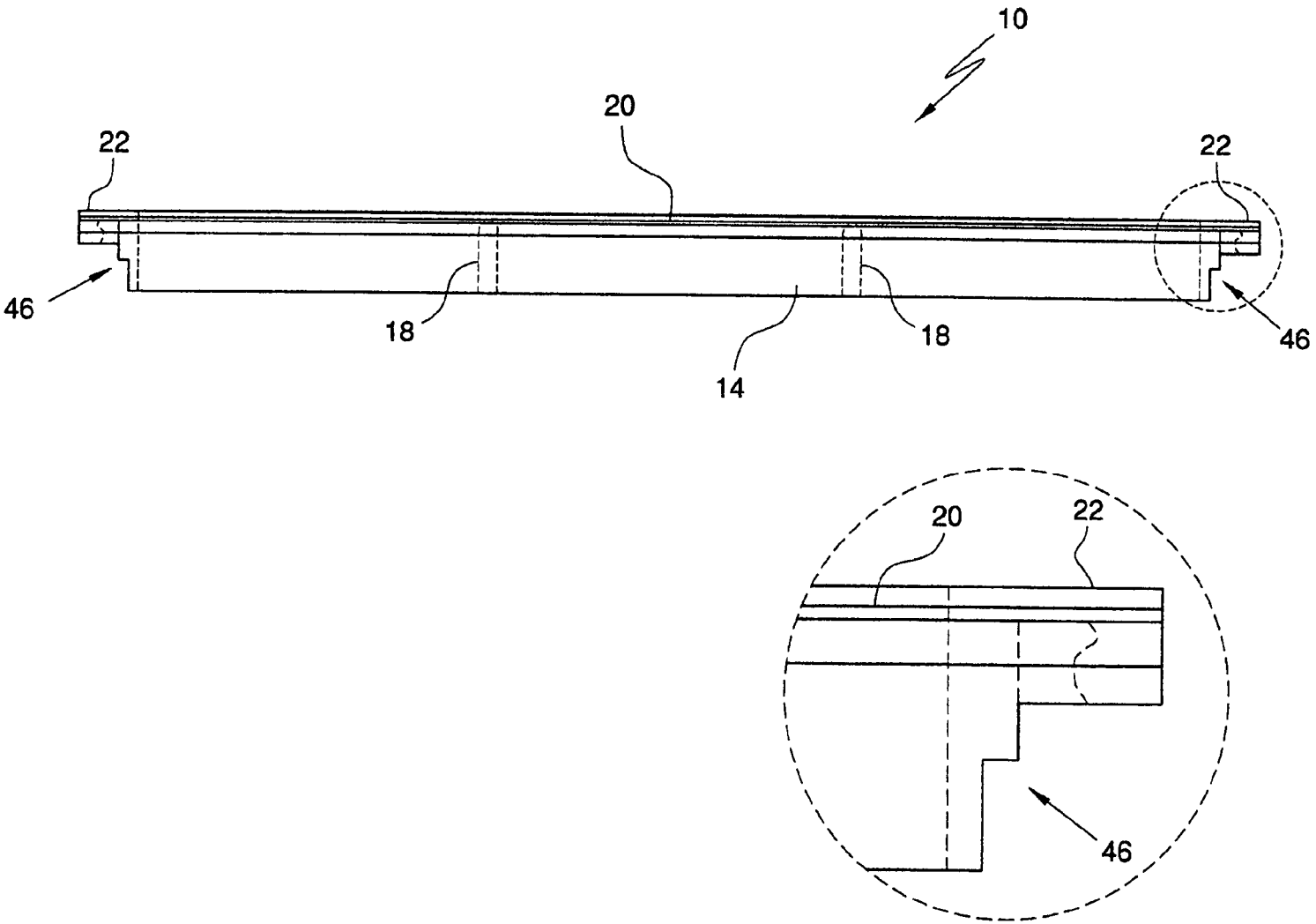
FIG. 2 shows a side view of the frame.
Figure 3:
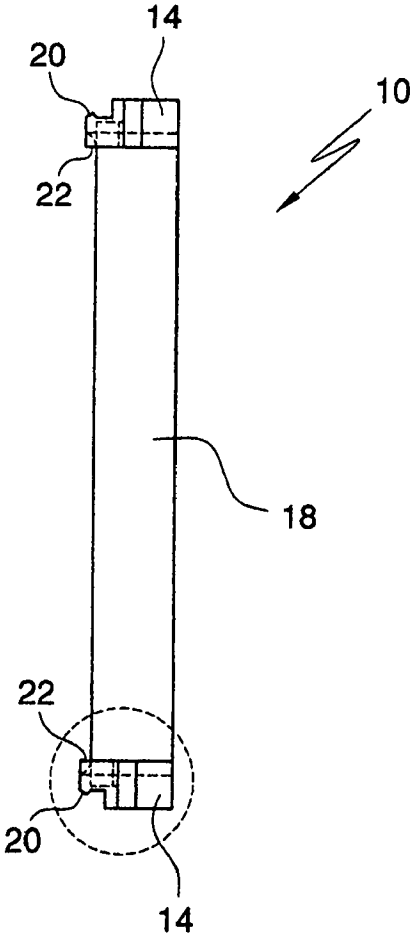
FIG. 3 shows an end view of the frame.
Figure 3:
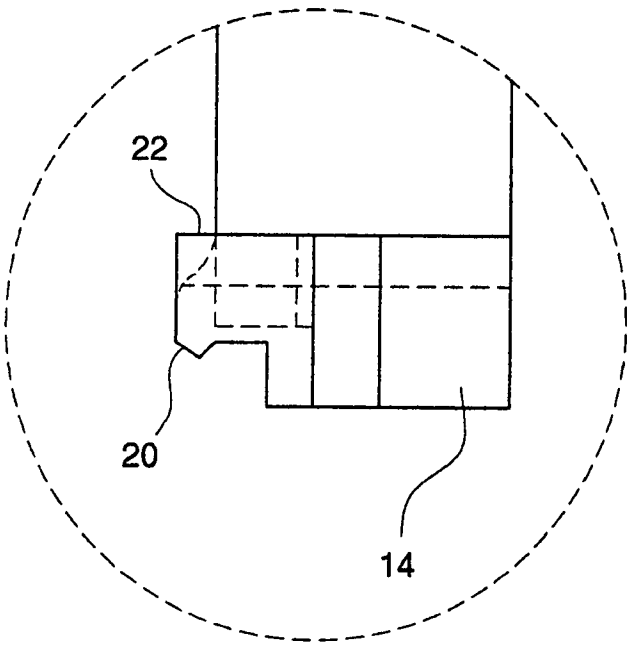

To facilitate stability of the screening assembly, each intermediate rail 36 is stepped, as shown at 44 in FIG. 5 of the drawings. Ends of the support members 14 are correspondingly stepped, as shown at 46 in FIG. 2 of the drawings, so that lateral movement of the support frame 10 on the intermediate rails 36 is inhibited.

To further inhibit lateral movement of the screen panel 32, ends of the screen panel 32 carry clips 46 which clip on to the clip-like formations 38 intermediate those slots 40 in which the boss-like formations 42 of its associated support frame 10 are received as shown in FIG. 5 of the drawings.

In FIGS. 6 and 7 of the drawings, another embodiment of a screening assembly 30 is shown. With reference to FIGS. 4 and 5 of the drawings, like reference numerals refer to like parts unless otherwise specified.

In this embodiment, instead of the boss like formations 42 with their associated clips 22, each support member 14 of the support frame 10 has a plurality of locating formations 50 defined at spaced intervals along an operatively bottom surface of the support member. Each locating formation 50 is shaped and dimensioned to engage a part of a head 52 of a locating pin 54 in a clip-like manner to secure the support frame 10 to the members 34 of the machine frame of the screen deck 30. The locating formation 50 overlies and clips to half of the head 52 of its associated locating pin 54. A locating formation 50 of an adjacent support frame 10 overlies and clips to the remaining half of the head 52 of the locating pin 54 to locate adjacent support frames 10 relative to each other. In addition, the shape of the locating formation 50 and the manner in which it abuts the side of the head 52 of its associated locating pin 54 serves to restrain the support frame 10 against lateral displacement relative to the locating pins 54.

Each locating pin 54 is secured directly to its associated member 34 of the machine frame of the screen deck 30 and the intermediate rail 36 is omitted. In this way, a rail type screen deck 30 can be converted to a pin type screen deck 30.

Each locating pin 54 is as described in the Applicant's co-pending Provisional Patent Application No. 2004905590 entitled "A screening module retaining member" filed 27 Sep. 2004. The contents of that provisional patent application are incorporated in this specification by reference.

It is therefore an advantage of the invention that a support frame 10 is provided which, being symmetrical about its longitudinal axis 24, improves the versatility of the support frame 10. The support frame 10 can therefore be rapidly placed in position on the screen deck 30 without a technician needing to know in which way the support frame 10 needs to be oriented. In addition, the same support frame 10 can be used with various types of screen panels 32. While the illustrated screen panel 32 is shown with continuous slots, any suitable screen panel 32 could be used with the support frame 10 to achieve fine screening or coarse screening.

It is therefore a further advantage of the invention that a support frame 10 is provided that facilitates rapid removal of a screen panel 32 secured to the support frame 10 to allow that screen panel 32 to be replaced by another screen panel 32. This is advantageous where a screen panel 32 has worn out or when it is desired to alter the application of the screen deck, for example, to change from one which does fine screening to one which does coarse screening or vice versa. It will be appreciated that it is not necessary to remove the support frame 10 from the underlying screen deck 30. All that is required is removal of the screen panel 32 from its associated support frame 10.

It is also to be noted that the upper surfaces of the struts 18 are rounded and that the screen panel 32 has channel defining members 48 which are received over the struts 18 but do not interlock with the struts 18. This allows vertical displacement of the screen panel 32 relative to the support frame 10 and assists in dislodging material blinding apertures of the screen panel 32.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A screening assembly support frame, comprising:

a pair of support members, wherein the support members are elongated members which are substantially parallel;

two or more struts, wherein the struts extend between the pair of support members thereby supporting and spacing the support members;

a clip integral with each of the support members and configured to engage complementary formations of a removable screen panel, wherein the clip is a profile located on a top outside surface of each support member and extends substantially the entire length of the support member; and a plurality of locating formations integral with the bottom of each of the support members and configured to removeably engage and secure to a head of a pin of an underlying screen deck, wherein the entire support frame is one piece of moulded material.

2. The screening assembly of claim 1, further comprising a rounded top on the struts, wherein the rounded top is configured to engage one or more channel members coupled to the bottom of the removable screen panel, wherein the one or more channels are configured to allow vertical displacement of the screen relative to the support frame but prevent horizontal movement of the screen relative to the support frame.

3. The screening assembly support frame of claim 1, wherein the support frame is molded from a synthetic plastic.

4. The screening assembly support frame of claim 3, wherein the synthetic plastic is a polyurethane.

5. The screening assembly support frame of claim 1, further comprising a steel reinforcing structure located within the support frame.

6. The screening assembly support frame of claim 5, wherein the steel reinforcing structure is located within the support members and the struts and has substantially the same shape as the support members and the struts.

* * * * *